United States Patent [19]

Perkins

[11] Patent Number: 4,730,671

[45] Date of Patent: Mar. 15, 1988

[54] VISCOUS OIL RECOVERY USING HIGH ELECTRICAL CONDUCTIVE LAYERS

[75] Inventor: Thomas K. Perkins, Dallas, Tex.

[73] Assignee: Atlantic Richfield Company, Los Angeles, Calif.

[21] Appl. No.: 509,838

[22] Filed: Jun. 30, 1983

[51] Int. Cl.[4] ..... E21B 43/24

[52] U.S. Cl. ..... 166/248; 166/302

[58] Field of Search ..... 166/248, 272, 302

[56] References Cited

U.S. PATENT DOCUMENTS

| | | | |
|---|---|---|---|
| 3,547,193 | 12/1970 | Gill | 166/248 |
| 3,946,809 | 3/1976 | Hagedorn | 166/248 |
| 4,084,639 | 4/1978 | Todd | 166/248 |
| 4,196,329 | 4/1980 | Rowland et al. | 166/248 |
| 4,401,162 | 8/1983 | Osborne | 166/248 |

*Primary Examiner*—Stephen J. Novosad
*Assistant Examiner*—William P. Neuder
*Attorney, Agent, or Firm*—M. David Folzenlogen

[57] ABSTRACT

A selectively electrically insulated, cemented and perforated tubular electrode provides a more effective system for electrically heating formations comprised of interbedded high and low electrical conductivity layers. The tubular electrode is located opposite the formation and is exteriorly insulated at an upper part of the formation and perhaps in low part of the formation. A central part of the tubular electrode is left free of electrical insulation. The tubular electrode is cemented in place and perforated at vertically spaced apart points into oil-bearing layers of the formation. The electrode may be a part of a casing string and the casing string specially designed to reduce alternating current hysteresis losses and current losses to the overburden.

14 Claims, 1 Drawing Figure

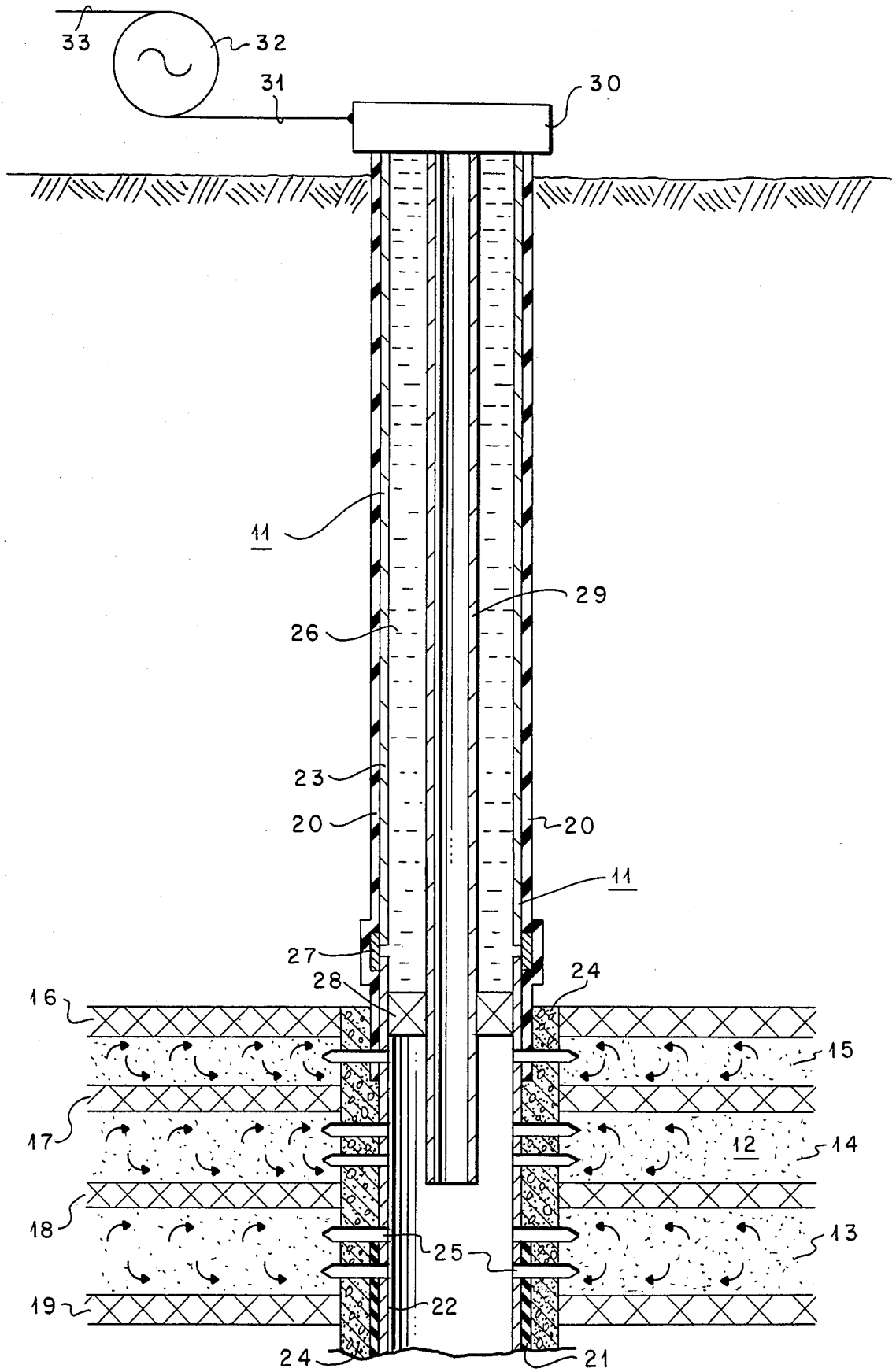
33
32
31
30
11
29
26
23
20
20
11
27
28
24
16
15
17
12
14
18
13
25
19
22
24
21

VISCOUS OIL RECOVERY USING HIGH ELECTRICAL CONDUCTIVE LAYERS

BACKGROUND OF THE INVENTION

This invention relates to recovery of oil from an interbedded, hydrocarbon bearing subterranean formation while electrically heating the producing strata. More specifically, this invention pertains to selective electrical resistance heating of a layered oil-bearing formation wherein power input and production outlet are controlled to selectively use the characteristics of the layered formation.

It has been proposed, for example, in U.S. Pat. Nos. 3,642,066; 3,874,450; 3,848,671; 3,948,319; 3,958,636; 4,010,799 and 4,084,637 to use electrical current to add heat to a subsurface pay zone containing tar sands or viscous oil to render the viscous hydrocarbon more flowable. Two electrodes are connected to an electrical power source and are positioned at spaced apart points in contact with the earth. Currents up to 1200 amperes are passed between the electrodes. The effectiveness of the electrical heating process depends on effective utilization of electrical power.

Certain formations, for example, the Ugnu formation in Alaska, are compresed of alternating relatively thin layers. Geologically such formations are called interbedded formations. In some interbedded formations, the conductivity of oil-bearing strata have an electrical conductivity which is much lower than the electrical conductivity of non-oil-bearing strata. For example, the Ugnu formation is comprised of alternating layers of sand containing oil and siltstone. The electrical conductivity of the siltstone layers is much higher than the electrical conductivity of the oil layers, for example, the siltstone conductivity may be ten times that of the oil-bearing sand. It is the primary object of this invention to provide a more efficient method of utilizing electrical power to apply heat to the oil-bearing layers of an interbedded formation.

SUMMARY OF THE INVENTION

In accordance with this invention, more effective electrical power utilization in an interbedded hydrocarbon-bearing subsurface formation is achieved with a tubular electrode arrangement that tends to focus the electrical current within the formation and to limit power dissipation in the overburden and underburden above and below the formation. An interbedded hydrocarbon-bearing formation is comprised of layers. In this invention, the hydrocarbon-bearing layers have a relatively low electrical conductivity in comparison to the other layers. In the essential embodiment of this invention, a tubular electrode is located opposite layers of the interbedded formation. All of the outer exterior surface of the tubular electrode in the upper part of the formation is electrically insulated. At least some of the outer exterior surface of the tubular electrode opposite the formation is left insulation-free. The tubular electrode is cemented in place throughout the part of the formation traversed by the electrode. The electrode and cement are perforated at vertically spaced apart points into the hydrocarbon-bearing part of the formation. The tubular electrode is electrically connected to an alternating current power source. When power is applied, this tubular electrode arrangement causes the electrical current to flow mostly into the high conductivity layers. The temperature of these layers rises and their conductivity increases several fold and the region of high power is dissipated farther into the formation. Since the high conductivity layers are relatively thin, the heat is readily conducted into the adjacent oil-bearing layers. As the hydrocarbon heats, its mobility is increased significantly and it flows along the heated boundaries toward the perforated tubular electode. Heat transfer to the moving oil cools the high conductivity layers, with the maximum cooling occurring near the electrode just where it is needed for effective power application.

In one of the principal embodiments of this invention, the tubular electrode is a part of a casing string. Both the exterior and interior surface of the upper part of the casing is electrically insulated. This upper part acts as an electrical conductor. The insulation reduces power losses to the overburden and corrosion. The upper part of the casing is made of nonmagnetic metal, for example aluminum. This reduses hysteresis losses in the conductor leading to the electrode and thereby increases effective use of the alternating current electrical power. An inner string of tubing provides a means of producing oil that flows into the tubular electrode through the perforations therein.

In a further embodiment, a packer and an electrically nonconducting packer liquid provide inner electrical insulation for the upper part of the casing string. In a still further embodiment, a lower portion of the exterior surface of the tubular electrode or casing is electrically insulated starting at a point opposite the formation and below the insulation-free portion of the tubular electrode or casing.

BRIEF DESCRIPTION OF THE DRAWING

The drawing is a side elevational view, partly schematic and partly in section, of a simplified focused tubular electrode arrangement.

DESCRIPTION OF PREFERRED EMBODIMENTS

In the drawing, there is illustrated a well completion system for selectively transmitting alternating current power into layers of a subsurface interbedded hydrocarbon-bearing formation comprised of hydrocarbon-bearing relatively low electrical conductivity layers and relatively high conductivity nonhydrocarbon-bearing layers. The power is used to apply heat to the hydrocarbonaceous material and thereby to stimulate production of oil from the formation.

More specifically, metal casing string 11 extends from near the surface of the earth downwardly at least to subsurface interbedded formation 12 where an electrode is to be located so that alternating current of up to 1200 amperes may be passed through the formation to another electrode or electrodes (not shown). An interbedded formation has been previously defined. This invention is useful to an interbedded formation containing a hydrocarbonaceous material whose flowability is increased by heat. For ease of description, this disclosure will refer to the Ugnu formation in Alaska. Accordingly, the formation shown is comprised of hydrocarbon-bearing sand layers 13, 14 and 15 and high electrical conductivity siltstone layers 16, 17, 18 and 19. There could be more or less than the number of layers shown. The electrical conductivity of the hydrocarbon-bearing layers is significantly lower than the electrical conductivity of the other layers. For example, in the Ugnu formation the electrical conductivity of the siltstone layers may be ten times the electrical conductivity of the oil-bearing shale layers.

For purposes of illustrating further embodiments of this invention, casing 11 is shown extending beyond lower layer 19; but it is to be understood that casing need not extend beyond this layer. Casing 11 is comprised of casing sections and is divided into lower casing part 22 and upper casing part 23. The lower casing part contains the portion of the casing that is used as a tubular electrode. The upper part is used as an electric conductor for the tubular electrode. In order to reduce the overall impedance of the transmission system and reduce magnetic hysteresis losses, upper casing part 23 is comprised of a nonmagnetic metal, such as for example, stainless steel or aluminum. Aluminum is preferred because of its high conductivity and availability. But aluminum is very susceptible to corrosion and metal loss due to current leaving the casing. Corrosion and premature loss of power to the overburden above formation 12 are effectively prevented by electrically insulating the upper casing part with inner electrical insulation 26 and outer electrical insulation 20. It is important that the outer electrical insulation covering the exterior surface of upper casing part 23 extend downward to a first preselected point. This point is selected so that insulation 20 traverses a part of formation 12 and lies opposite a part of the formation. This point is selected to focus current into layers of the formation, preferably the central layers of the formation. An insulation-free portion of the lower casing part serves as the current emitting surface of the tubular electrode. The current applies heat to the formation. Insulating the casing down to this point has a further advantage in that it is below last coupling 27 which connects the upper casing part to the lower casing part. This also assures that the outer insulation extends over a part of lower casing part 22. The outer electrical insulation thereby prevents loss of current to the overburden and prevents corrosion of the nonmagnetic casing. This outer insulation may be comprised of coatings, pipe wrapping, extruded plastic, heat skrinkable sleeves, or other similar insulating or nonconductive corrosion protection materials. Some of the insulation may be pre-applied.

It is highly desirable that inner electrical insulation 26 also extend downward below last coupling 27 which connects the upper casing part to the lower casing part and into lower casing part 22. This prevents interior corrosion of nonmagnetic metal casing 23. The inner electrical insulation may be comprised of a pipe liner, an extruded liner, coatings or other similar internal insulating or nonconductive corrosion protection materials; but the preferred inner insulation is shown as packer 28 and nonconductive packer fluid 26 which is placed in the annulus above the packer between casing 11 and tubing 29. Packer fluid may be any standard nonconductive or oil base fluid or thixotropic substance. Tubing string 29 extends downward from the surface of the earth inside casing 11 through at least a part of lower casing part 22. The tubing may extend beyond the casing. The tubing string is adapted to be used for production between the surface and a predetermined subsurface point so that it will conduct fluids produced into lower casing part 22.

Casing 11 is shown connected to typical metal christmas tree 30 represented schematically. The christmas tree is shown electrically connected via conductor 31 to alternating current power source 32 which is also connected to one or more other electrodes (not shown). Power source 32 is capable of generating voltages up to several thousand volts. Typically, a well may include a larger concentric surface casing string (not shown) which extends through fresh water zones to a predetermined point and is sealed in place with cement. If this surface casing were made of ordinary steel casing, it would cause hysteresis losses in upper casing part 23. Accordingly, if there is a surface casing, the surface casing string will also be comprised of a nonmagnetic metal and will also be covered with exterior surface electrical insulation.

It was previously mentioned that lower casing part 22 may or may not extend below formation 12. If the casing extends below the formation, it is preferred that the exterior surface of a lower portion of the casing be electrically insulated. This enhances the focusing characteristics of the electrode. Accordingly, as shown, second outer electrical insulation 21 covers the exterior surface of a lower portion of casing 11. This electrical insulation extends upward traversing a part of formation 12.

Between the upper end of a second outer electrical insulation 21 and the lower end of outer electrical insulation 20 is a portion of lower casing part 22 that is left free of electrical insulation. As shown, this insulation-free portion is opposite layers 13, 14, 15, 17 and 18 of formation 12 and acts as a tubular electrode for passing alternating current into the formation. The annulus between lower casing part 22 and the borehole has been filled with enough cement to at least cover the exterior of the insulation-free portion of lower casing part 22 and the part of first electrical insulation 20 which traverses a part of the formation, for example it is shown traversing high conductivity layer 16 and part of underlying low electrical conductivity layer 15. Lower casing part 22 and cement 24 have been perforated at vertically spaced apart points with perforations 25 in a manner such that there are flow passages extending into a hydrocarbon-bearing part of the formation, for example, any combination of layers 13, 14 and 15.

In application, a borehole large enough for casing string 11 is drilled to a predetermined depth. This borehole traverses at least some layers of interbedded formation 12. Casing 11 is lowered downward into the borehole. The part of casing 11 that is to be used as a tubular electrode is lowered exposed so that its outer surface can contact the formation opposite the predetermined point where the tubular electrode will be used to apply heat to a subsurface formation. Thereafter, as the tubular electrode is lowered, the exposed exterior surface of the tubular electrode above the portion left free of electrical insulation is covered with electrical insulation 20. Part of the tubular sections may be preinsulated so that, for example, only the ends and couplings need to be insulated. The insulation-free portion of the tubular electrode and at least a part of the upper insulated portion of the tubular electrode is lowered to a preselected first point. This first preselected point has been selected so that the insulation-free portion lies opposite layers of formation 12 and so that the insulated upper portion traverses a part of the formation, for example high conductivity layer 16 and lies opposite a part of underlying low electrical conductivity layer 15. As previously mentioned, optionally it may be desirable in some situations to have the casing traversed the entire formation or the entire group of layers of interest and extend deeper into the earth. In such situations, the method could include the step of covering the exposed exterior surface of a lower portion of the tubular electrode with electrical insulation as the tubular electrode is being lowered into the borehole. In this case, the first preselected point will also be selected so that the insulated lower portion traverses a part of the formation, for example high electrical conductivity layer 19 and lies opposite a part of overlying low electrical conductivity layer 13. In addition, it was optionally mentioned that the tubular electrode could be a part of a casing string so that the upper part of the casing string could act as a conductor for alternating current to flow into the tubular electrode. In this situation, the method could include the step of covering the exposed exterior surface of the casing string above the insulated portion of the tubular electrode as the casing string is lowered into the borehole. Preferably, in this latter optional situation, casing 11 would be divided into upper casing part 23 and lower casing part 22. As the lower casing part is lowered and the time comes to connect it to the upper casing part, the method would include the step of connecting the lower casing part to a nonmagnetic metal upper casing part. After the casing has been installed, the method could include the step of lowering a tubing string with a packer downward from near the surface of the earth into and through upper casing part 23 and into lower casing part 22. The packer is thereafter be set at a point inside the lower casing part below the lowest point of the upper casing part. An electrically nonconductive liquid is added to the annulus between the tubing and the casing string above the packer. This effectively insulates the interior surface of the nonmagnetic upper casing part and thereby prevents corrosion to the interior surface of the nonmagnetic part of the casing string.

Alternating current from power source 32 is caused to be flowed from the insulated part of the tubular electrode into the layers of formation 12 adjacent the uninsulated part of the electrode. The high electrical conductivity layers carry most of the current and the overlying and underlying low electrical conductivity hydrocarbon layers can thus be viewed as electrically insulating. The insulated perforated tubular electrode and characteristics of the formation thereby selectively combine to focus the current within the formation and limit power dissipation in the overburden and underburden. As time passes, the high electrical conductivity layers increase in temperature with the increase occurring more swiftly near the electrode well. As the temperature increases, the conductivity of these layers increases (for example, three to fivefold). This moves the region of high power dissipation farther from the tubular electrode or producing well. The high conductivity layers are relatively thin. Heat, therefore, is readily conducted into the adjacent hydrocarbon-bearing layers. As the hydrocarbonaceous material heats, its mobility increases significantly and it can thus flow along the heated boundaries towards the producing tubular electrode well. The flowable oil in the hydrocarbon-bearing layers is forced towards the heated boundaries by thermal expansion, decompression (that is, pressure expansion), comparison, solution gas drive and gravity drainage. Heat transfer to each moving layer of oil cools the overlying and underlying high electrical conductivity layers with the maximum cooling occurring near the tubular electrode well where the cooling is needed most for more effective application of the alternating current. Oil is produced through the perforated tubular electrode to the surface of the earth through tubing 29.

From the foregoing, it can be seen that specially insulated, located and perforated tubular electrodes provide far more effective use of alternating current power in an interbedded hydrocarbon-bearing formation. Reasonable variations and modifications are possible within the scope of this disclosure without departing from the spirit and scope of the invention.

What is claimed is:

1. In a method of recovering oil from an interbedded hydrocarbon-bearing subsurface formation wherein the electrical conductivity of the hydrocarbon-bearing layers is significantly lower than the electrical conductivity of the other layers, the steps comprising:

(a) lowering into a borehole traversing layers of said formation a metal tubular electrode;

(b) covering the exposed exterior surface of an upper portion of said tubular electrode with electrical insulation as said tubular electrode is being lowered into said borehole while leaving a portion of the exterior surface of said tubular electrode free of electrical insulation;

(c) lowering said insulation-free portion of said tubular electrode and at least a part of said upper portion of said tubular electrode to a preselected first point, said first point having been selected so that said insulation-free portion lies opposite a part of said formation and said insulated upper portion traverses a part of said formation;

(d) thereafter adding cement to said borehole in a manner such that said cement covers the exterior of said insulation-free portion of said tubular electrode and said part of said upper portion traversing said part of said formation;

(e) perforating said electrode and cement at second preselected vertically spaced apart points, said points having been selected to be opposite a part of said hydrocarbon-bearing part of said formation;

(f) connecting an alternating current power source to said tubular electrode;

(g) causing alternating current to flow from said tubular electrode into said layers of said formation opposite said tubular electrode; and (h) producing oil from said formation, said oil flowing into said tubular electrode.

2. The method of claim 1 wherein said electrode is a part of a casing string and at least a part of said alternating current flows through said casing string to said electrode and said method includes the following steps:

(i) covering the exposed exterior surface of said casing string above said insulated portion of said electrode as said casing string is being lowered into said borehole.

3. The method of claim 2 wherein the casing string is divided into an upper casing part and a lower casing part and the method includes the following steps:

(j) connecting said lower casing part to a nonmagnetic metal upper casing part;

(k) lowering a tubing string with a packer downward from near the surface of the earth into and through said upper casing part and into said lower casing part;

(l) setting said packer at a point inside said lower casing part below the lowest point of said upper casing part; and (m) adding an electrically nonconductive liquid to the annulus between said tubing and said casing string above said packer.

4. A well completion for recovering oil from an interbedded hydrocarbon-bearing subsurface formation wherein the electrical conductivity of the hydrocarbon layers is significantly lower than the electrical conductivity of the other contiguous layers comprising:

(a) a metal casing string extending from the surface of the earth in a borehole leading into said formation, said casing string being divided into an upper casing part and a lower casing part, said upper casing part being a nonmagnetic metal, said casing string extending downward in a borehole from near the surface of the earth in a manner such that said lower casing part traverses layers of said formation, a portion of said lower casing part being electrical insulation-free, said insulation-free portion being opposite layers of said formation;

(b) electrical outer first insulation on the exterior surface of said upper casing part and a portion of said lower casing part, said first insulation extending downward from near the surface of the earth and traversing a part of said formation;

(c) cement in the annulus between said lower casing part and said borehole, said cement covering the exterior of said insulation-free portion of said lower casing part and the part of said first insulation traversing said part of said formation;

(d) flow passages in said lower casing string and said cement extending into a hydrocarbon-bearing part of said formation at vertically spaced apart points;

(e) inner electrical insulation covering most of the interior surface of said upper casing part and a portion of said lower casing part;

(f) an inner tubing string extending from surface of the earth downward inside said casing string through at least a portion of said lower casing part, said tubing string being adapted to conduct fluids between the surface and a predetermined subsurface point; and (g) an alternating current power source electrically connected to said casing string.

5. The well completion of claim 4 wherein said upper casing part is comprised of aluminum.

6. The well completion of claim 4 wherein a packer means is located below said upper casing part and said inner electrical insulation is an electrically nonconducting packer fluid in the annulus between said tubing string and the portion of said casing string above said packer means.

7. The well completion of claim 6 wherein the upper casing portion is comprised of aluminum.

8. The well completion of claim 4 wherein said lower casing part traverses said formation and there is electrical second outer insulation on the exterior surface of a lower portion of said lower casing part below said electrical insulation-free portion, said second outer insulation traversing a part of said formation.

9. The well completion of claim 8 wherein said upper casing part is comprised of aluminum.

10. The well completion of claim 8 wherein a packer means is located below said upper casing part and said inner electrical insulation is an electrically nonconducting packer fluid in the annulus between said tubing string and the portion of said casing string above said packer means.

11. The well completion of claim 10 wherein the upper casing portion is comprised of aluminum.

12. In a method of recovering oil from an interbedded hydrocarbon-bearing subsurface formation wherein the electrical conductivity of the hydrocarbon-bearing layers is significantly lower than the electrical conductivity of the other layers, the steps comprising:

(a) lowering into a borehole traversing layers of said formation a metal tubular electrode;

(b) covering the exposed exterior or surface of a lower portion of said tubular electrode with electrical insulation as said tubular electrode is being lowered into said borehole;

(c) covering the exposed exterior surface of an upper portion of said tubular electrode with electrical insulation as said tubular electrode is being lowered into said borehole while leaving a portion of the exterior surface of said tubular electrode free of electrical insulation, said electrical insulation-free portion of said exterior surface being between said insulated lower portion and said insulated portion;

(d) lowering said insulated lower portion, said insulation-free portion of said tubular electrode and at least a part of said upper portion of said tubular electrode to a preselected first point, said first point having been selected so that said insulation-free portion lies opposite a part of said formation and said insulated upper portion and said insulated lower portion traverse a part of said formation;

(e) thereafter adding cement to said borehole in a manner such that said cement covers the exterior of said insulation-free portion of said tubular electrode and said part of said upper portion traversing said part of said formation;

(f) perforating said electrode and cement at second preselected points, said points having been selected to be opposite a part of said hydrocarbon-bearing part of said formation;

(g) connecting an alternating current power source to said tubular electrode;

(h) causing alternating current to flow from said tubular electrode into said layers of said formation opposite said tubular electrode; and (i) producing oil from said formation, said oil flowing into said tubular electrode.

13. The method of claim 12 wherein said electrode is a part of a casing string and at least a part of said alternating current flows through said casing string to said electrode and said method includes the following steps:

(i) covering the exposed exterior surface of said casing string above said insulated portion of said electrode as said casing string is being lowered into said borehole.

14. The method of claim 13 wherein the casing string is divided into an upper casing part and a lower casing part and the method includes the following steps:

(j) connecting said lower casing part to a nonmagnetic metal upper casing part;

(k) lowering a tubing string with a packer downward from near the surface of the earth into and through said upper casing part and into said lower casing part;

(l) setting said packer at a point inside said lower casing part below the lowest point of said upper casing part; and (m) adding an electrically nonconductive liquid to the annulus between said tubing and said casing string above said packer.

* * * * *